US006874658B2

(12) United States Patent
Thomas et al.

(10) Patent No.: US 6,874,658 B2
(45) Date of Patent: Apr. 5, 2005

(54) DESIGN AND METHOD FOR PRODUCING A SEALING AND SHUT-OFF VALVE SYSTEM ON A PLURAL CHAMBER DISPENSING TUBE

(76) Inventors: Ralph H. Thomas, 106 Ross St., Clark, NJ (US) 07066; Thomas J. Duncan, 317 Cheryl Dr., Toms River, NJ (US) 08753; William J. Weber, 382 Ski Trail, Kinnelon, NJ (US) 07405

( * ) Notice: Subject to any disclaimer, the term of this patent is extended or adjusted under 35 U.S.C. 154(b) by 14 days.

(21) Appl. No.: 10/431,093

(22) Filed: May 7, 2003

(65) Prior Publication Data

US 2003/0209561 A1 Nov. 13, 2003

Related U.S. Application Data

(60) Provisional application No. 60/378,237, filed on May 7, 2002.

(51) Int. Cl.[7] ..... B65D 35/22

(52) U.S. Cl. ..... 222/94; 222/213; 222/494

(58) Field of Search ..... 222/94–96, 145.1, 222/129, 1, 206, 212, 213–215, 107, 209, 490–491, 494, 496; 137/521, 527, 843, 512.15, 512.4, 854

(56) References Cited

U.S. PATENT DOCUMENTS

| | | | | | |
|---|---|---|---|---|---|
| 2,589,743 | A | * | 3/1952 | Snaith | 222/94 |
| 3,241,727 | A | * | 3/1966 | Heckman | 222/213 |
| 3,913,809 | A | * | 10/1975 | Nilson | 222/494 |
| 4,099,651 | A | * | 7/1978 | von Winckelmann | 222/94 |
| 4,905,819 | A | * | 3/1990 | Clements et al. | 206/5.1 |
| 4,949,877 | A | * | 8/1990 | Hanna et al. | 222/341 |
| 4,984,715 | A | * | 1/1991 | Green | 222/129 |
| 6,321,947 | B2 | * | 11/2001 | Gross et al. | 222/145.1 |
| 6,398,077 | B1 | * | 6/2002 | Gross et al. | 222/145.1 |

* cited by examiner

*Primary Examiner*—Frederick Nicolas
(74) *Attorney, Agent, or Firm*—Stanley H. Kremen

(57) ABSTRACT

The invention discloses and claims five different embodiments of a plural chambered dispensing tube assembly that prevents products separated by tube chambers from mixing prior to being dispensed by providing a seal at the dispensing end. The seal is an integral part of the tube assembly.

6 Claims, 9 Drawing Sheets

DESIGN AND METHOD FOR PRODUCING A SEALING AND SHUT-OFF VALVE SYSTEM ON A PLURAL CHAMBER DISPENSING TUBE

CROSS REFERENCE TO RELATED APPLICATIONS

This is a U.S. nonprovisional utility patent application that is also described in and claims the benefit of U.S. provisional patent application 60/378,237 filed on May 7, 2002, entitled DESIGN AND METHOD FOR PRODUCING A SEALING AND SHUT-OFF VALVE SYSTEM ON A DUAL CHAMBERED DISPENSING TUBE, and incorporated entirely by reference herein.

BACKGROUND OF THE INVENTION

This invention relates to providing a positive shut off at the dispensing end of a plural chambered dispensing tube. There are several patented plural chambered tubes which can provide simultaneous dispensing of products from each chamber. All these designs can provide separation of the chamber contents except in one critical location, i.e., the dispensing end of the nozzle under the cap. In the dispensing region, the tube contents can mix during the filling process, in handling, and during and after dispensing. On certain applications, this area of mixing renders the separate chamber design almost useless. The design function of a plural chamber tube is incomplete without a closing function at the dispensing end.

The plural chamber tube designs that are currently state-of-the-art do not address this functional problem. All current designs utilize a simultaneous molding process to attach the tube body to the shoulder or dispensing end of the tube. There are several currently known methods wherein this can be accomplished, including injection molding and compression molding.

The object of this invention is to prevent mixing of multiple products being dispensed from a plural chambered tube prior to and after dispensation. The disclosure herein describes five embodiments that provide a seal and shut off of the product at the dispensing end of the tube to prevent cross-contamination of the plural chamber materials. The designs of these embodiments would be incorporated into the tooling of the tube manufacturing equipment. This invention when incorporated into current designs would have a negligible manufacturing cost increase over the current designs. It will enable an economical tube design to be used for many products which now require significantly more expensive packaging to function and maintain product integrity.

SUMMARY OF THE INVENTION

The invention discloses an improvement that can be incorporated into current plural chamber tube designs to prevent cross-contamination during filling, transportation, and final use. The improvement described herein is absent in all current plural chambered tubes. The improvement exists in five embodiments, the implementations of which depend on final use application, but all five are manufactured in a similar manner.

BRIEF DESCRIPTION OF THE DRAWINGS

FIG. 6(A) is a front elevational cross sectional schematic while FIG. 6(B) is a bottom plan schematic showing the dispensing end of the tube.

FIG. 8(A) is a front elevational cross sectional schematic while FIG. 8(B) is a bottom plan schematic showing the dispensing end of the tube.

DETAILED DESCRIPTION OF THE INVENTION

In order to solve the problem wherein multiple products in a plural chambered dispensing tube mix together inside the tube, a plastic seal is molded to the tube assembly as an integral part thereof. A properly placed plastic seal at the dispensing end of the tube will prevent mixing of said products.

Figure 1:
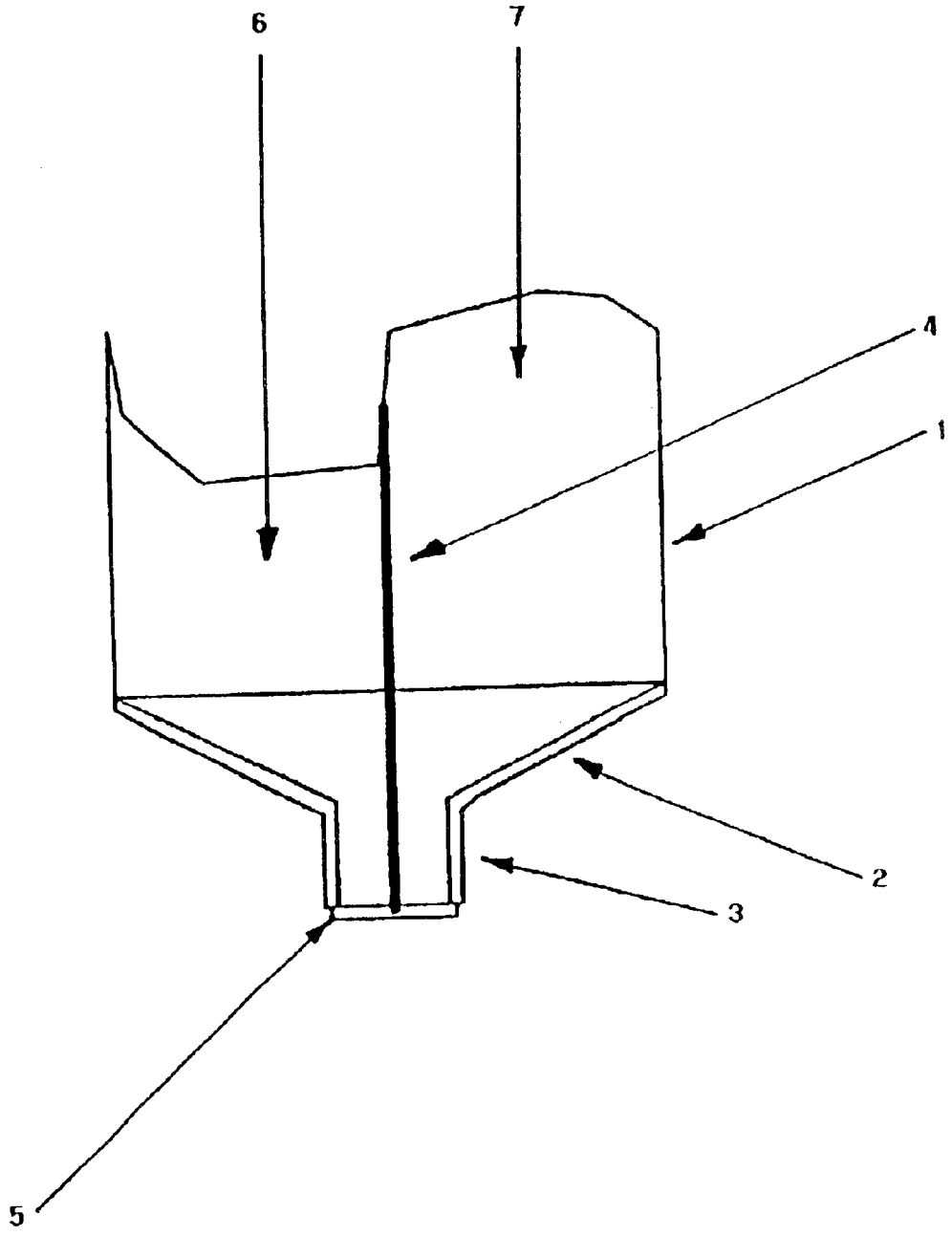
FIG. 1 shows a schematic in cross section of the dispensing end of a dual chambered tube for the first embodiment of the invention, said embodiment being the incorporation of a molded plastic seal on the dispensing end of the tube nozzle.

The first embodiment of the invention is illustrated in FIG. 1. For simplicity, a dual chambered tube is shown, but the same principles apply to tubes with multiple chambers. The tube assembly comprises a tube body, 1, which is molded to a one end of a tube shoulder, 2. Molded to the other end of the tube shoulder is a nozzle, 3. A septum or divider, 4, separates chambers 6 and 7 which hold the two products to be dispensed. The septum, 4, shown herein is a planar piece of plastic that is molded to the inside of the tube. This provides a positive seal preventing the product in chamber 6 from mixing with the product in chamber 7. The septum need not be planar, but instead can have any shape that would produce multiple isolated chambers inside the tube. An example of the shape of such a septum would be similar to a paddle wheel on a steamboat. Each paddle would then be molded to the inside wall the tube. Such plural chambered tubes are current state-of-the-art. The first embodiment of this invention represents an improvement over current designs. A plastic cap, 5, is permanently molded to tube nozzle, 3. This cap hermetically seals the dual chambers, 6 and 7, until said cap is mechanically removed using a sharp blade on first use of the tube. This embodiment is suitable for dispensing highly reactive products in a one-use application.

Figure 2:
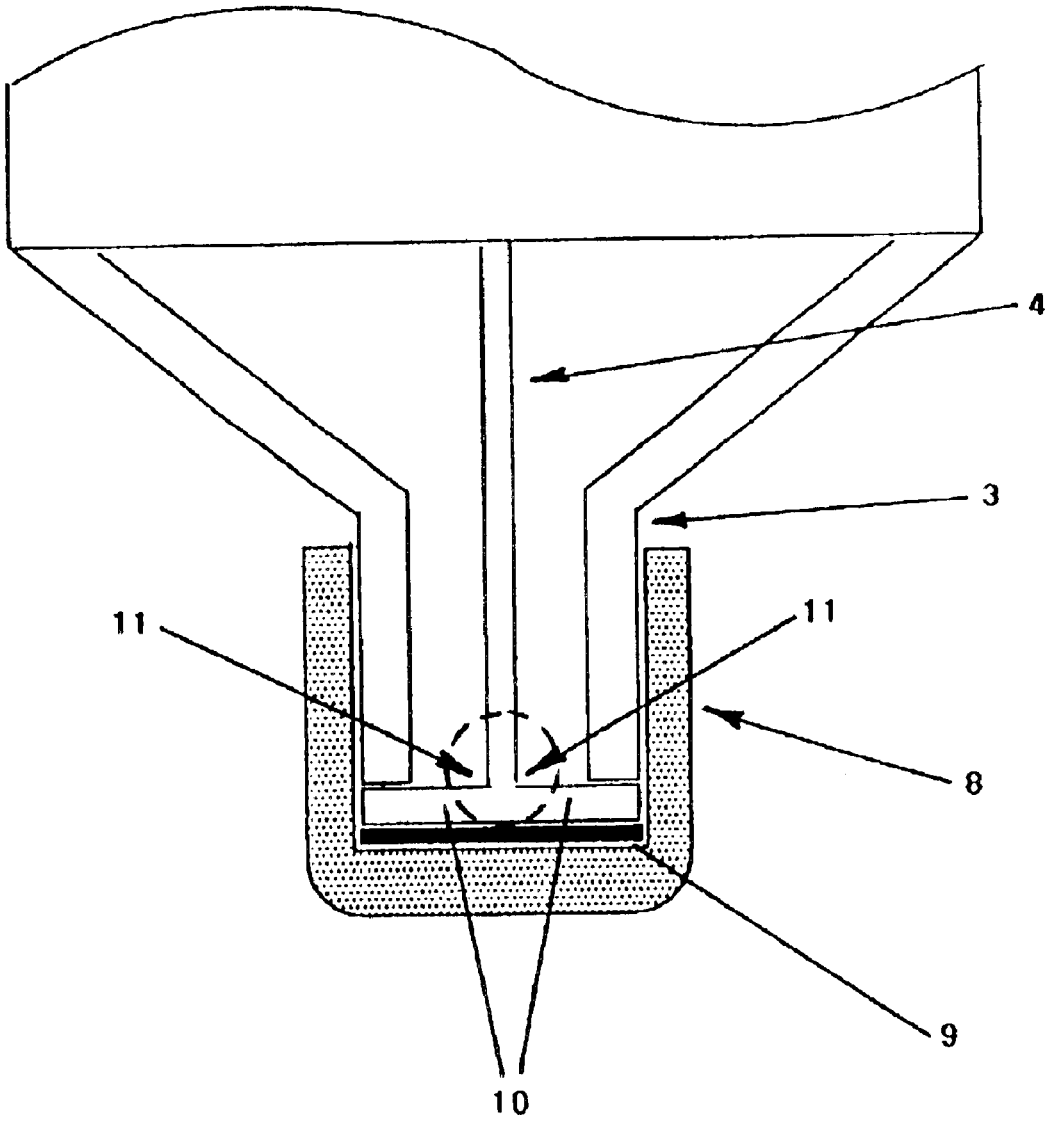
FIG. 2 shows a schematic in cross section of the dispensing end of a dual chambered tube for the second embodiment of the invention, said embodiment being the incorporation of flapper valves attached to the septum and cut at the nozzle end.

The second embodiment uses the aforementioned plural chambered dispensing tube assembly design as a starting point. The improvement lies in the use of flapper valves to permit flow of products in only one direction, whereby the products may only exit the tube. When pressure is applied to the tube body, the flapper valves move in such a manner as to permit flow of material past the valves. As soon as pressure is no longer applied, the flapper valves return to the shut position. FIG. 2 illustrates the second embodiment of the invention. The flapper valves, 10, are attached by molding to septum, 4, at hinge areas, 11. However, they are not attached to nozzle, 3. Usually, the memory of the plastic will cause the flapper valves to return to their original shut position when pressure is no longer applied to the tube body. In the figure, a removable cap, 8, applies positive pressure to the flapper valves to keep them in the sealed position when the dispensing tube is not being used. Examples of removable caps that may be used are the screwing type or the tight fitting type. Optionally, a liner, 9, may be used to separate the cap from the flapper valves. The flapper valves are formed by the mandrel in the molding process that produces the tube shoulder. As the molten plastic is forced into the mold as well as around the mold, the septum in contact with the molten plastic becomes molten and forms a homogeneous mixture with the shoulder. The molding pins and an internal tube mandrel are machined to form the flapper valves and hinge areas. The flapper valves and hinge areas are the same plastic material used to form the shoulder. However, an additional step is added to the tube manufacturing sequence to cut the tube seal immediately after molding, producing the plural valve embodiment that seals against the dispensing end of the tube and is further secured by the cap when applied. For a dual chambered tube, the cutting mechanism would be a dual blade system which would be designed into the tube manufacturing machine as a separate station prior to cap application.

Figure 3:
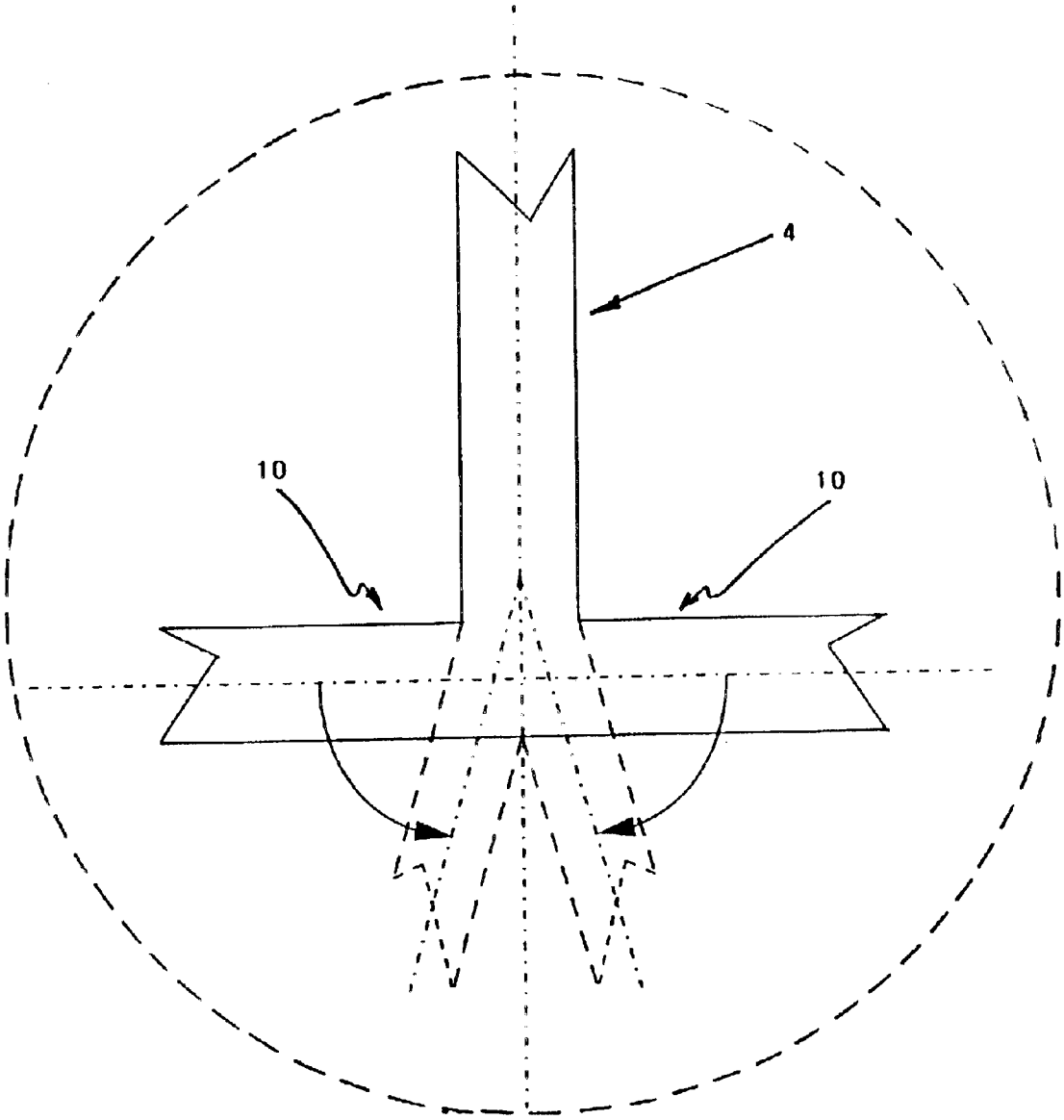
FIG. 3 shows a partial view of the schematic shown in FIG. 2, demonstrating the operation of the flapper valves in the second embodiment of the invention.

The dashed circle in FIG. 2 circumscribing the septum, 4, the flapper valves, 10, and the hinge areas, 11, represents the partial view that is shown magnified in FIG. 3. FIG. 3 is a schematic illustration of the operation of the flapper valves of said second embodiment. When no pressure is applied to the tube body, the flapper valves, 10, remain in the position shown as the solid line valves. When pressure is applied to the tube body, the material in the chambers is forced against the flapper valves, and the flapper valves move as shown to permit the material to flow past the valves to the dispensing end of the tube.

Figure 4:
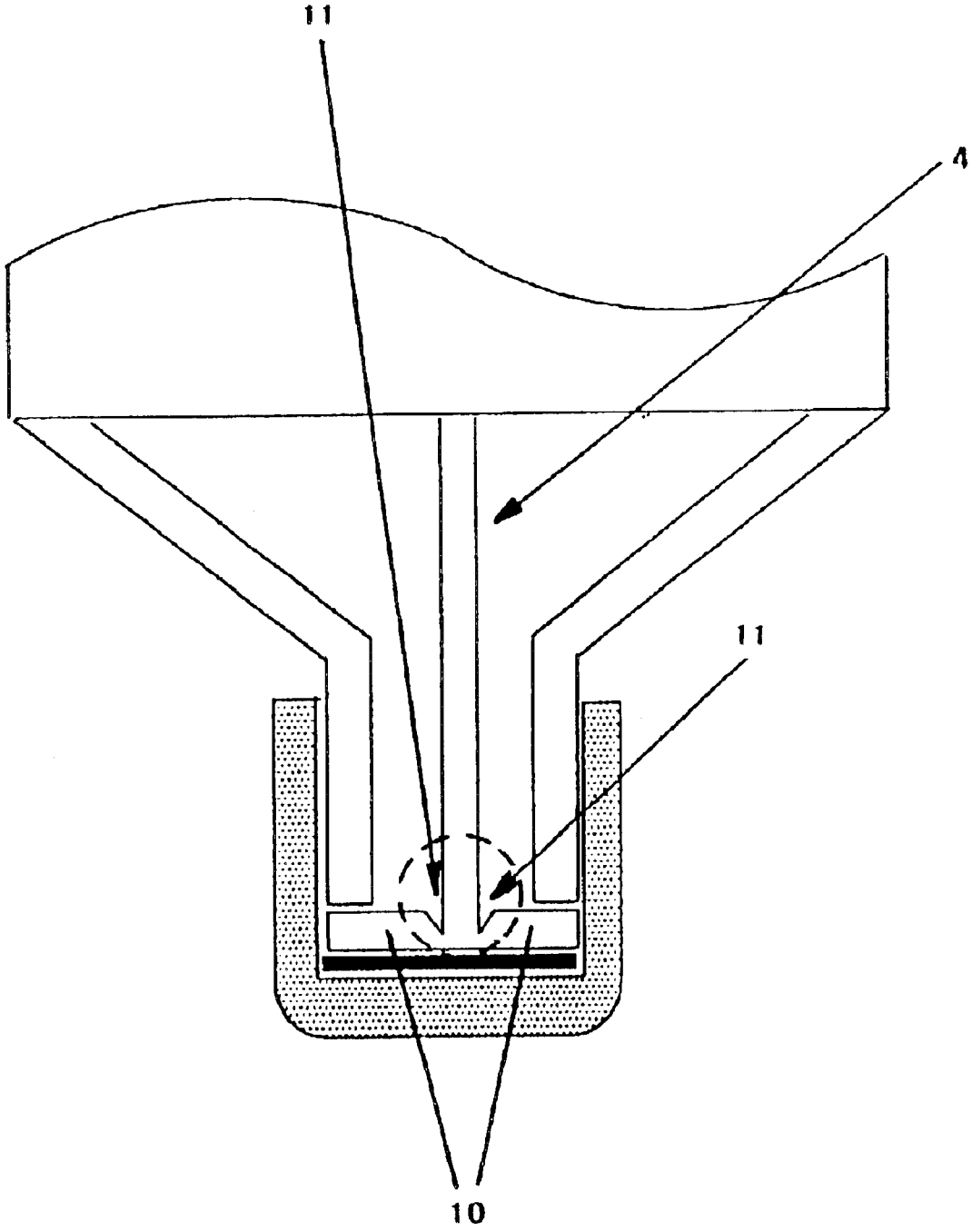
FIG. 4 shows a schematic in cross section of the dispensing end of a dual chambered tube for the third embodiment of the invention, said third embodiment differing from the second embodiment in that the flapper valves are notched at their points of contact with the septum.

The third embodiment of the invention is very similar to the second embodiment. The only difference is the incorporation of a recess formed by the mandrel to produce a more freely acting hinge. This is shown in FIG. 4. As in the second embodiment, flapper valves, 10, are attached to septum, 4, at hinge areas, 11. However, said hinge areas are notched to permit easier movement of the flapper valves. In both the second and third embodiments, the valve mechanism is permanently molded as an extension of the septum and the products are kept separate until outside the tube. The cap is used to enhance the valve seal by holding the flaps against the land of the tube neck.

Figure 5:
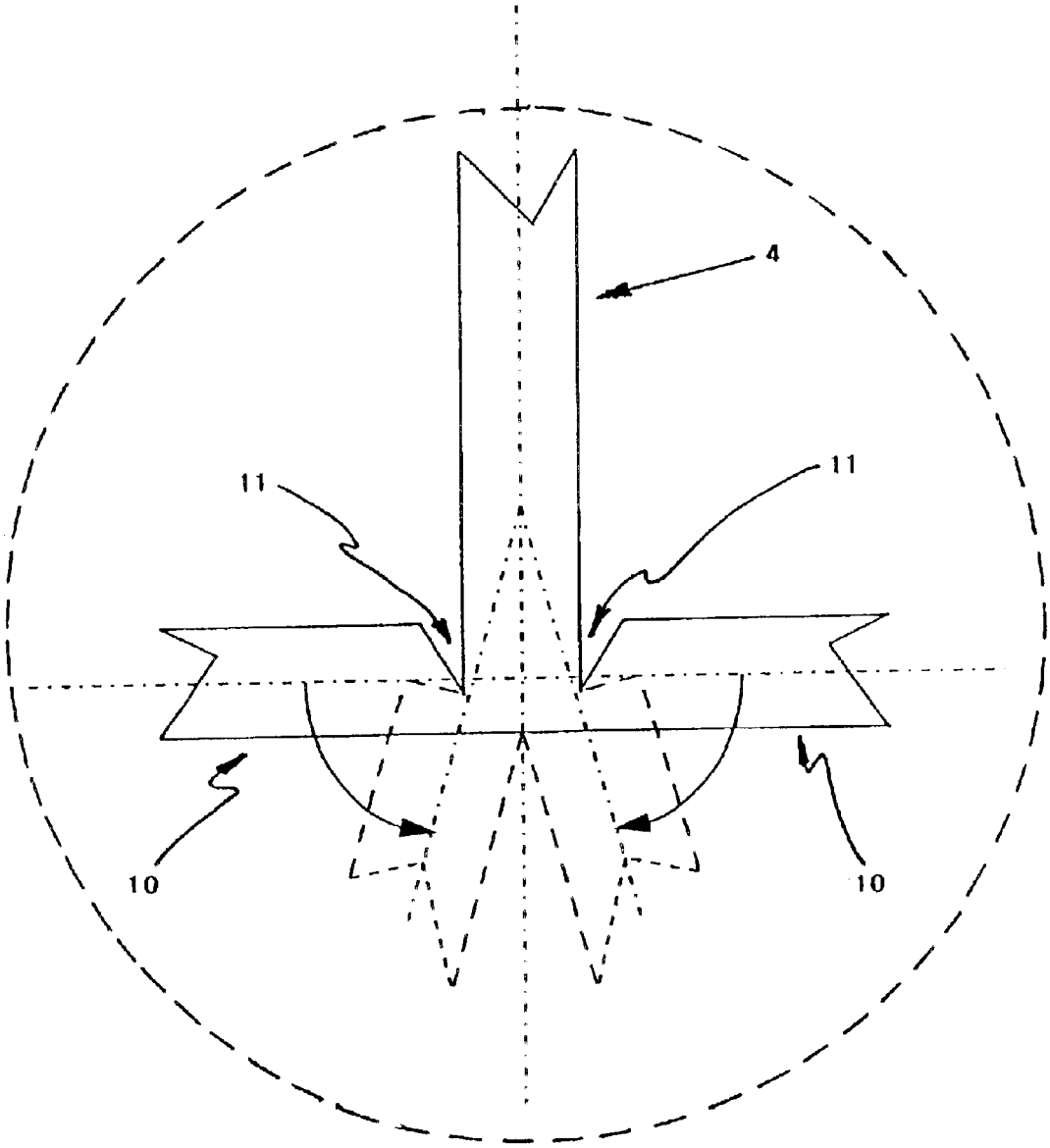
FIG. 5 shows a partial view of the schematic shown in FIG. 4, demonstrating the operation of the flapper valves in the third embodiment of the invention.

The dashed circle in FIG. 4 circumscribing the septum, 4, the flapper valves, 10, and the hinge areas, 11, represents the partial view that is shown magnified in FIG. 5. FIG. 5 is a schematic illustration of the operation of the flapper valves of said third embodiment. When no pressure is applied to the tube body, the flapper valves, 10, remain in the position shown as the solid line valves. When pressure is applied to the tube body, the material in the chambers is forced against the flapper valves, and the flapper valves move as shown to permit the material to flow past the valves to the dispensing end of the tube. However in this case the notched hinge areas, 11, permit easier movement of the flapper valves.

Figure 6:
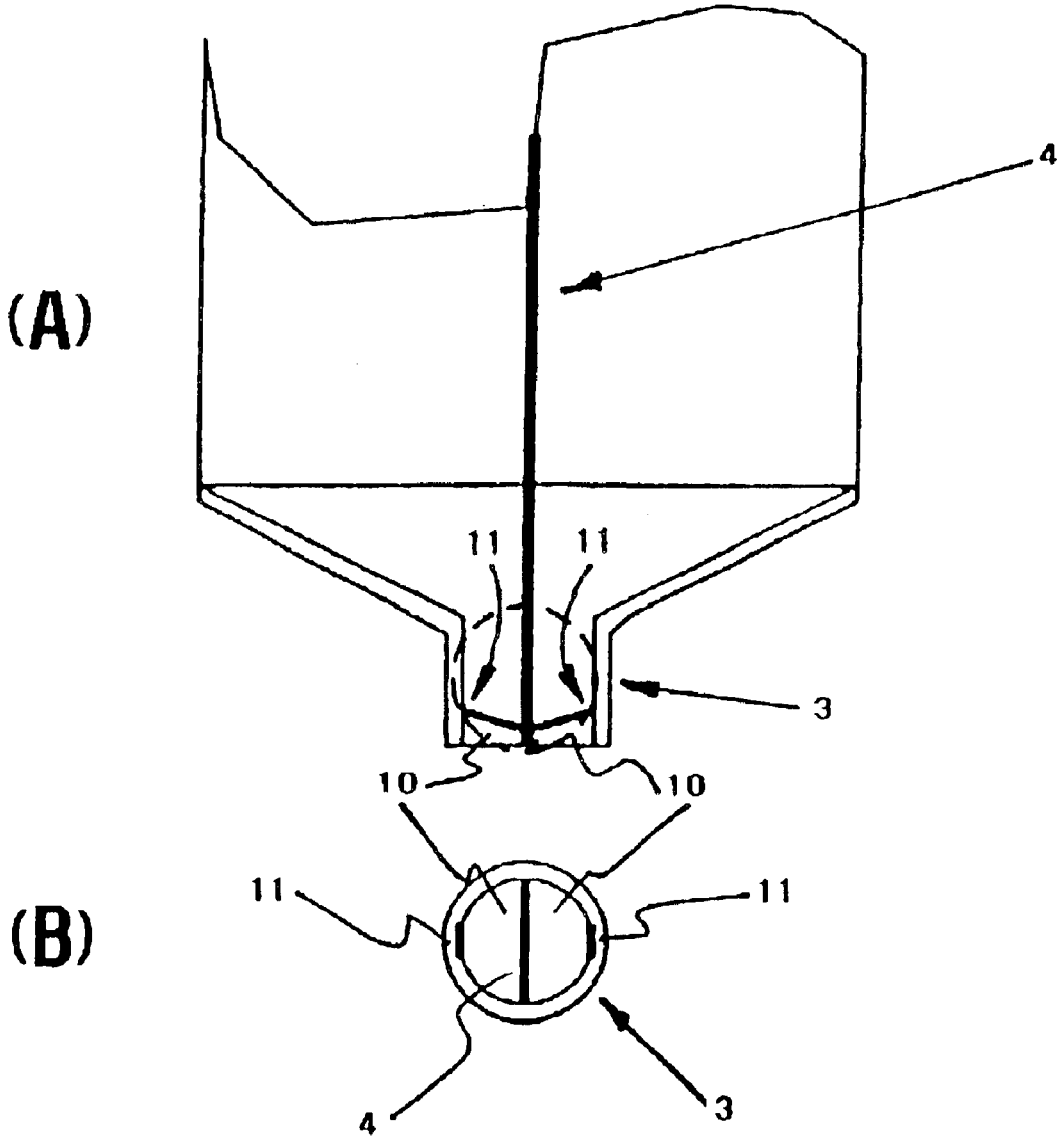
FIG. 6 shows a schematic in cross section of the dispensing end of a dual chambered tube for the fourth embodiment of the invention, said embodiment being the incorporation of flapper valves attached to the nozzle in the interior rather than at the end of said nozzle.

The fourth embodiment of the invention incorporates the attachment by molding of two flapper valves, 10, to the inner circumference of nozzle, 3, at hinge areas, 11. This is schematically illustrated in FIG. 6. The flapper valves, 10, would normally close against the septum, 4, which extends to the end of nozzle, 3. Note that the flapper valves are attached to the inside wall of the nozzle in the interior of said nozzle rather than at its dispensing end. Before use and when a cap covers the nozzle, the cap forces the flapper valves to seal against the septum. The cap is not shown in the figure. When the multiple products are dispensed, the material causes the flapper valves to close when the products stop flowing. Products inside the flapper valves are prevented from cross mixing. The flapper valves are formed in the molding process that produces the tube shoulder, using pins that would otherwise be used to form a clear opening. As the molten plastic is forced into and/or around the mold, the divider in contact with the molten plastic becomes molten and forms a homogeneous mixture with the shoulder. The molding pins and an internal tube mandrel are machined to form the flapper valve and hinges. The flapper valve and hinges are the same plastic material used to form the shoulder. FIG. 6(A) is an illustration representing a front elevational cross sectional view of the dispensing end of the tube, while FIG. 6(B) shows a bottom view displaying said dispensing end.

Figure 7:
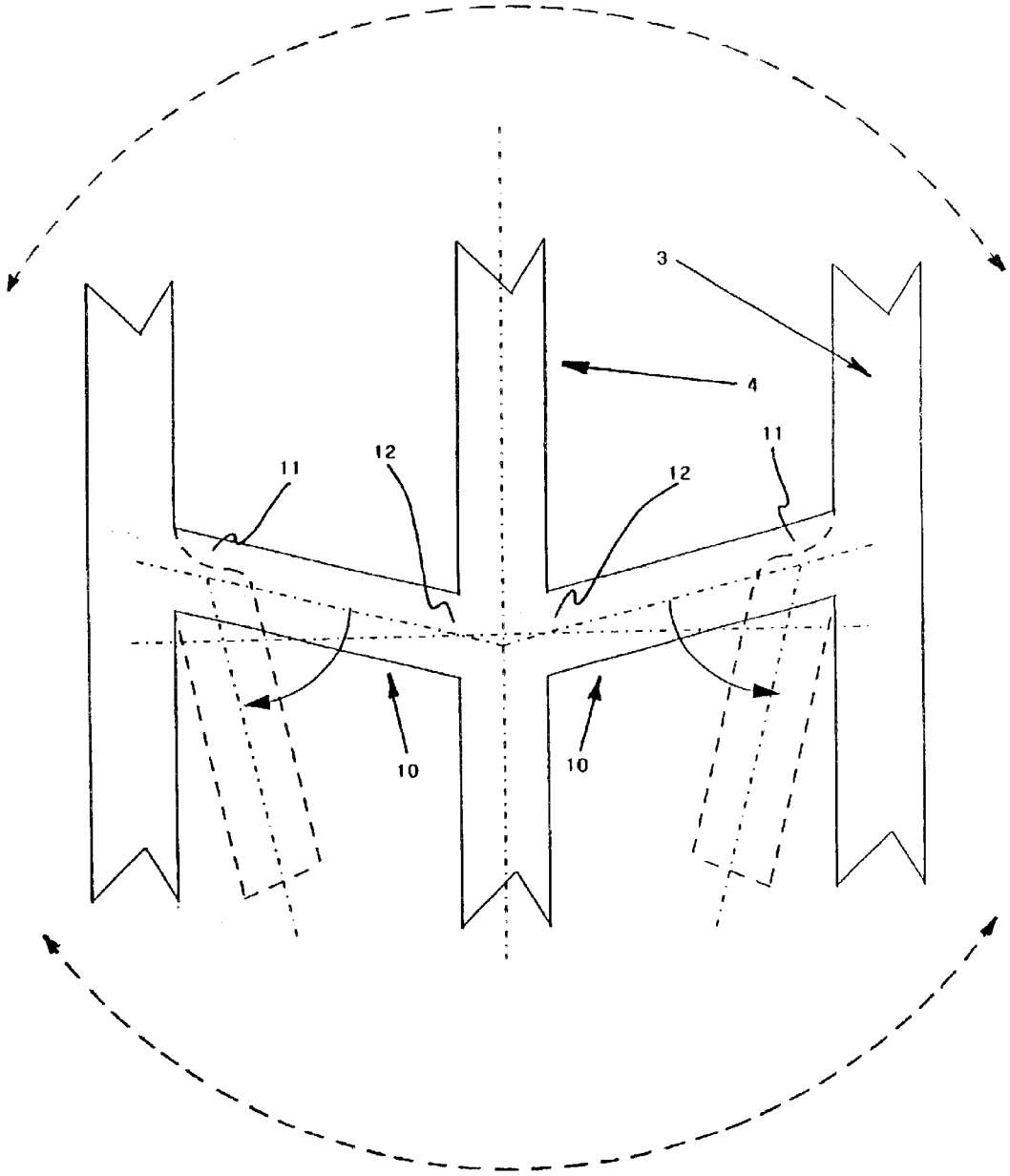
FIG. 7 shows a partial view of the schematic shown in FIG. 7(A), demonstrating the operation of the flapper valves in the fourth embodiment of the invention.

The dashed circle in FIG. 6(A) circumscribing the septum, 4, the flapper valves, 10, and the hinge areas, 11, represents the partial view that is shown magnified in FIG. 7. FIG. 7 is a schematic illustration of the operation of the flapper valves of said fourth embodiment. When no pressure is applied to the tube body, the flapper valves, 10, remain in the position shown as the solid line valves. When pressure is applied to the tube body, the material in the chambers is forced against the flapper valves, and the flapper valves move as shown to permit the material to flow past the flapper valves to the dispensing end of the tube. However in this embodiment, the material from the plural chambers flow through the center of the tube while the flapper valves are pushed towards the wall of the nozzle. In all of the other embodiments, the flapper valves are pushed toward the septum, and the material from the plural chambers flow between the flapper valves and the nozzle wall.

Figure 8:
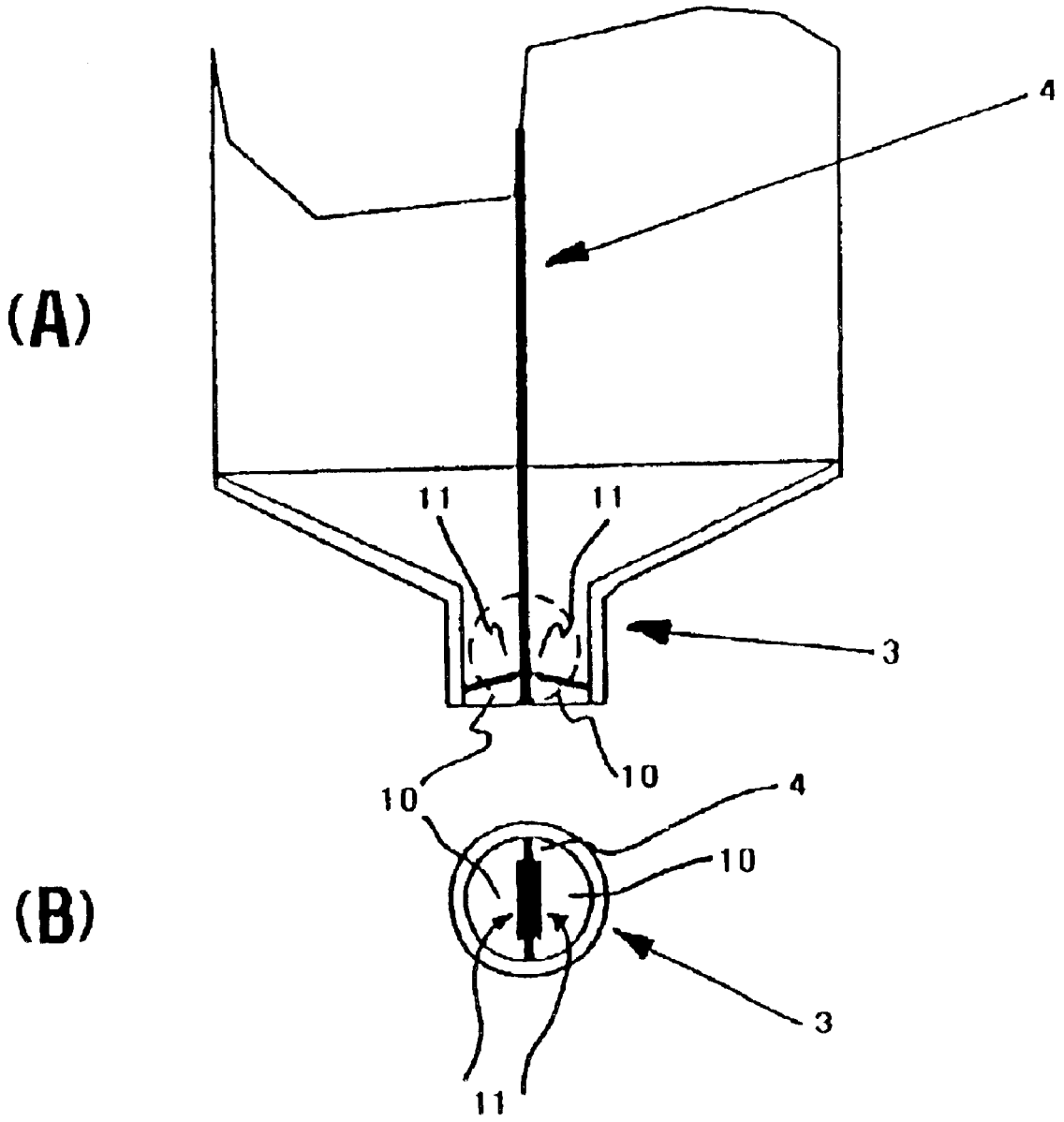
FIG. 8 shows a schematic in cross section of the dispensing end of a dual chambered tube for the fifth embodiment of the invention, said embodiment being the incorporation of flapper valves attached to the septum in the interior rather than at the end of said nozzle.

The fifth embodiment of the invention is similar to the second embodiment except that the flapper valves are formed as part of the septum during the molding process. FIG. 8 illustrates this embodiment. The flapper valves, 10, are on the surface of septum, 4, and said flapper valves close against the inner circumference of the tube neck. Note that the flapper valves, 10, are attached to septum, 4, at hinge areas, 11, in the interior region of nozzle, 3, and not at its dispensing end. This design variation provides increased separation of the flow, which may be desirable for some products. Similar to the other embodiments, when the cap is in place during filling, transportation, or after use, the flapper valves are sealed against the inner circumference of the tube neck. The cap is not shown in the figure. When product is dispensed from the dual chambers, the valves are forced open. When the flow of material ceases, the internal memory of the material closes the valves to prevent cross mixing of undispensed materials in the tube chambers. The manufacturing methods are also similar to the other embodiments. A mandrel in the tube body and pins in the mold form the valve flappers. As the molten plastic is forced into and around the mold, the divider in contact with the molten plastic becomes molten and forms a homogeneous mixture with the shoulder. The mandrel and pins form the inside of the shoulder and the flapper valves. The molten material of the divider and the flapper valves become fused together forming the hinge. FIG. 8(A) is an illustration representing a front elevational cross sectional view of the dispensing end of the tube, while FIG. 8(B) shows a bottom view displaying said dispensing end.

Figure 9:
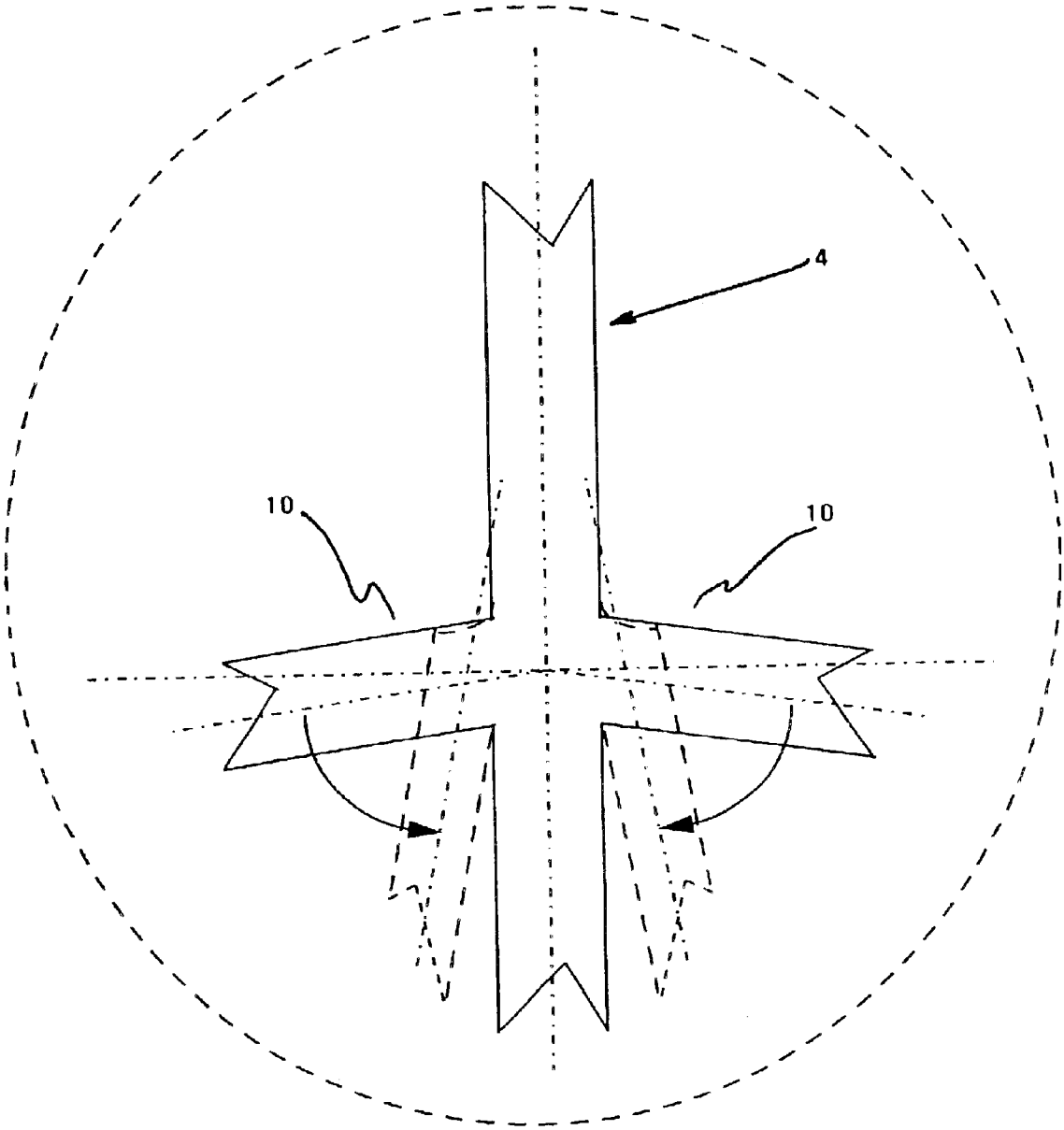
FIG. 9 shows a partial view of the schematic shown in FIG. 8(A), demonstrating the operation of the flapper valves in the fifth embodiment of the invention.

The dashed circle in FIG. 8(A) circumscribing the septum, 4, the flapper valves, 10, and the hinge areas, 11, represents the partial view that is shown magnified in FIG. 9. FIG. 9 is a schematic illustration of the operation of the flapper valves of said fifth embodiment. When no pressure is applied to the tube body, the flapper valves, 10, remain in the position shown as the solid line valves. When pressure is applied to the tube body, the material in the chambers is forced against the flapper valves, and the flapper valves move as shown to permit the material to flow past the flapper valves to the dispensing end of the tube. As in the second and third embodiments, the flapper valves move toward the center of the tube and away from the nozzle wall while the materials from the plural chambers are being dispensed. However, in this case, the flapper valves are restrained from touching each other by the thickness of septum, 4.

We claim the following:

1. A plural chambered dispensing tube assembly that prevents products separated into chambers of the tube from mixing together prior to being dispensed, comprising:

a) a tube body;

b) a tube shoulder, having a large end and a small end, joined at its large end to one end of said tube body;

c) a tube nozzle, having one end joined to the small end of said tube shoulder, its other end forming a product dispensing region;

d) at least one divider in the tube and extending through the tube shoulder to the dispensing region said divider positioned essentially parallel to the expected direction of flow of the products, whereby the products in said tube are separated; and, e) a seal in the vicinity of the dispensing region to prevent mixing of said products wherein the seal is formed as a plurality of flapper valves:

(1) that are hinged at the divider;

(2) that are positioned essentially perpendicular to the expected direction of flow of the products;

(3) that are biased to be closed to prevent mixing of said products at the dispensing region;

(4) that are forced open to allow the products to be dispensed; and, (5) that are sufficiently biased to close after the products have been dispensed thereby re-sealing the dispensing region.

2. The plural chambered dispensing tube assembly of claim 1 wherein said flapper valves are flexibly attached at the divider.

3. The plural chambered dispensing tube assembly of claim 1 wherein said flapper valves are flexibly attached at the inside wall of the nozzle.

4. The plural chambered dispensing tube assembly of claim 1 wherein the flapper valves are hinged at the inside wall of the nozzle.

5. The plural chambered dispensing tube assembly of claim 1, also comprising a cap over the dispensing region and the valves.

6. The plural chambered dispensing tube assembly of claim 1 wherein said seal is an integral part of said tube assembly.

* * * * *